United States Patent [19]

Thompson

[11] 3,949,949

[45] Apr. 13, 1976

[54] WEB TENSION CONTROL

[75] Inventor: James K. Thompson, Kansas City, Mo.

[73] Assignee: Phillips Petroleum Company, Bartlesville, Okla.

[22] Filed: Apr. 25, 1975

[21] Appl. No.: 571,668

[52] U.S. Cl. ..... 242/75.43; 226/30; 242/75.53

[51] Int. Cl.[2] ..... B65H 75/43

[58] Field of Search..... 242/75.53, 75.43, 75.44, 242/75.51, 75.5; 226/27, 28, 30, 38; 83/74

[56] References Cited

UNITED STATES PATENTS

| | | | |
|---|---|---|---|
| 2,995,968 | 8/1961 | Tomberg | 83/74 |
| 3,294,301 | 12/1966 | Richter | 226/27 |
| 3,648,911 | 3/1972 | Pekrul | 226/30 |
| 3,889,895 | 6/1975 | Edes | 242/75.43 |

*Primary Examiner*—Edward J. McCarthy

[57] ABSTRACT

Apparatus is disclosed for controlling the tension on a web which is fed to a blanking press so as to maintain proper alignment of printing on the resulting blanks. This is accomplished by means of an adjustable air brake attached to a shaft which supports a roll from which the web is withdrawn. A sensing means is employed to detect register marks on the web and to control the pneumatic pressure supplied to the air brake.

7 Claims, 3 Drawing Figures

WEB TENSION CONTROL

It is common practice in the paperboard container industry to form container blanks from a printed web of paperboard. The web is unwound from a roll and delivered to a blanking press which cuts container blanks from the web. The web is usually printed before the blanks are cut. Accordingly, it is important to maintain tension on the web so that the printing is in proper registration on the finished blanks.

In accordance with this invention, improved apparatus is provided for controlling the rate at which a web is fed to receiving device, such as a blanking press. An air brake is attached to the shaft which supports a roll of paperboard or the like from which the web is supplied. By controlling the pneumatic pressure applied to the air brake, the tension on the web is adjusted, and this in turn controls the registration of the printed web entering the press. A sensing device, such as a photoelectric cell, is provided to detect suitable indicating marks on the web. This device provides an output signal which is utilized to adjust the pneumatic pressure applied to the air brake. The retarding force exerted by the brake is decreased as the web is withdrawn and the roll becomes smaller.

In the accompanying drawing.

Figure 1:
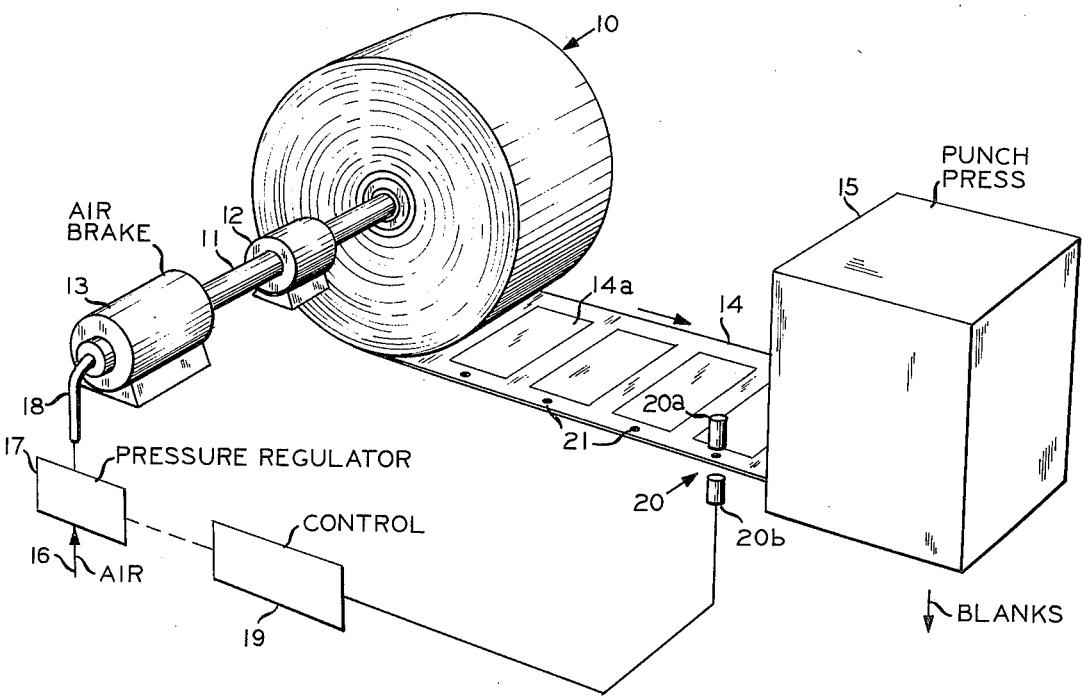
FIG. 1 is a schematic representation of the control apparatus of this invention.

Referring now to the drawing in detail and to FIG. 1 in particular, there is shown a roll of paperboard, cardboard or the like from which blanks are to be cut. These blanks can form the side walls of cylindrical containers, for example. Roll 10 is secured to a rotatable shaft 11 which extends through one or more support elements 12. An air brake 13 is secured to one end of shaft 11. The force exerted by brake 13 to resist rotation of roll 10 is a function of the pneumatic pressure applied to the brake. A web 14 is withdrawn from roll 10 and passed to a blanking punch press 15 which cuts individual blanks from the web. Press 15 is provided with a suitable drive mechanism, such as drive rollers, not shown, which serve to pull web 14 into the press. Web 14 can have a series of printed labels 14*a* therein so that preprinted blanks are formed.

A source of pneumatic pressure to actuate brake 13 is supplied by a conduit 16 which is connected to the inlet of a pressure regulator 17. A conduit 18 extends between the outlet of pressure regulator 17 and air brake 13. Pressure regulator 17 is provided with an adjustable setpoint which regulates the pressure in conduit 18. This setpoint is controlled by the output signal from control mechanism 19. A sensing device 20, which can comprise a light source 20*a* and a photocell 20*b*, is positioned adjacent web 14 to detect opaque marks 21 on the edge of the web. These marks are spaced with respect to printed labels 14*a* such that signals from photocell 20*b* are representative of the proper registration at which web 14 is fed into press 15.

Figure 2:
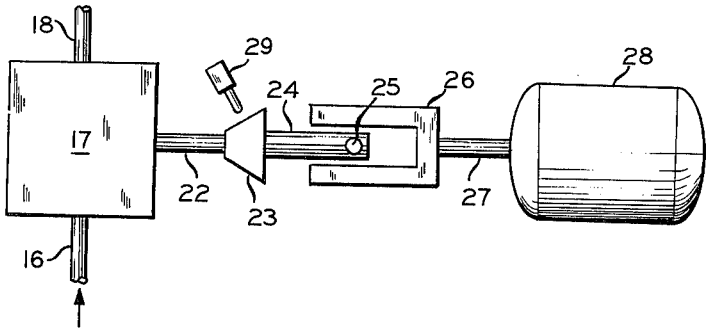
FIG. 2 is a schematic representation of mechanical components of the control system of FIG. 1.

The mechanical components of control system 19 are illustrated in FIG. 2. Pressure regulator 17 is provided with a setpoint adjustment in the form of a rotatable shaft 22. A tapered wheel 23 and a shaft 24 are connected to shaft 22. Shaft 23 carries a pin 25 which extends through a slot in a rotatable member 26. Member 26 is connected to the drive shaft 27 of a reversible motor 28. Accordingly, rotation of motor 28 in a first direction serves to rotate setpoint adjustment 22 in a first direction, and rotation of motor 28 in a second direction serves to rotate setpoint adjustment 22 in a second direction. A limit switch 29 is positioned adjacent wheel 23 for reset purposes, as described hereinafter.

Figure 3:
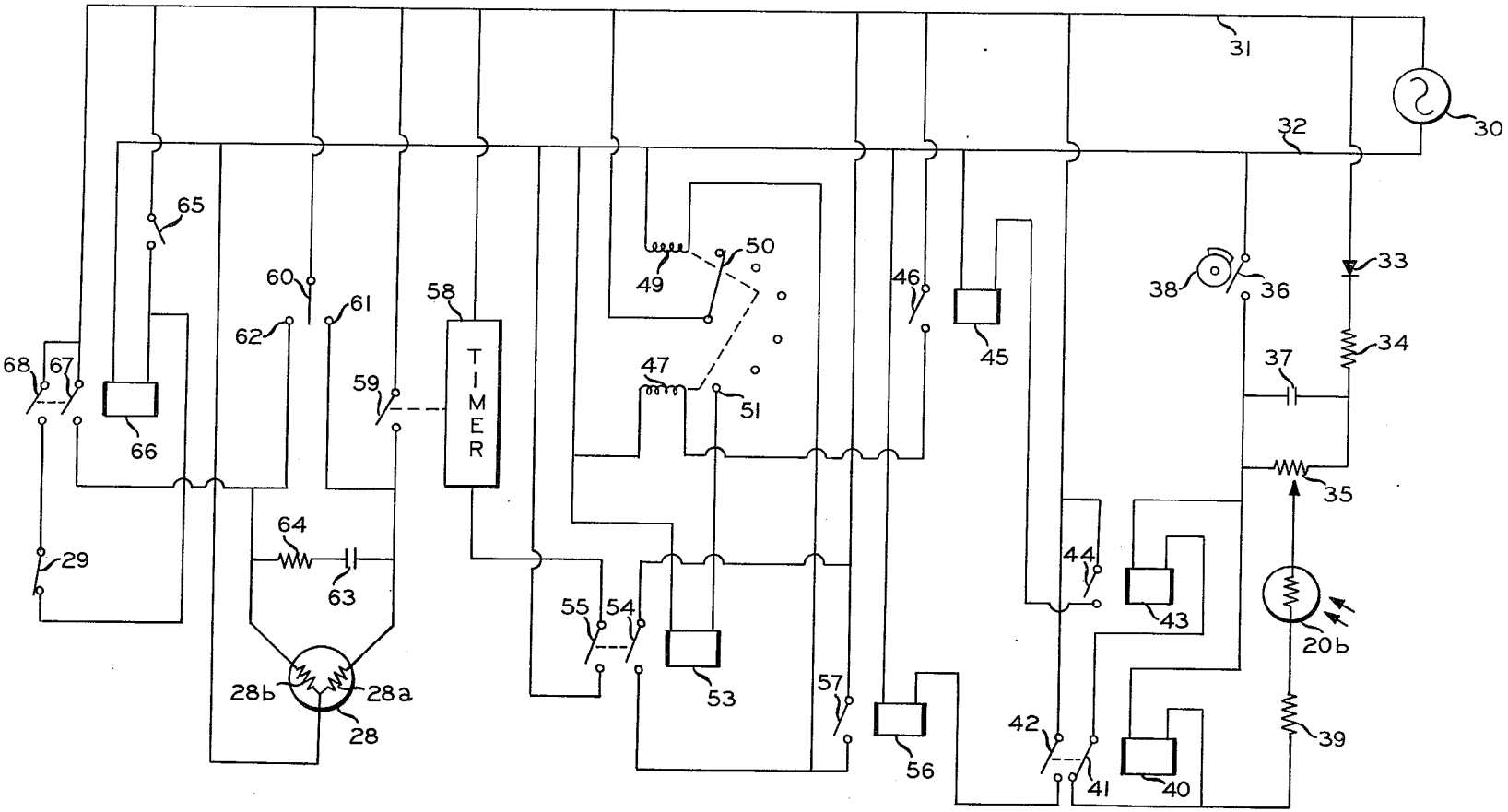
FIG. 3 is a schematic circuit drawing of the electrical components of the control system of FIG. 1.

The electrical components of control system 19 are illustrated in FIG. 3. The circuit of FIG. 3 is energized by a current source 30 which is connected across power leads 31 and 32. A rectifier 33, a resistor 34, a potentiometer 35 and a switch 36 are connected in series between leads 31 and 32. A capacitor 37 is connected in parallel with potentiometer 35. Switch 36 is actuated by a cam 38 which is connected to press 15 of FIG. 1. The cam is connected to the press in a manner such that switch 36 is closed momentarily each time the press is actuated to cut a blank from web 14. Photocell 20*b*, a resistor 39 and relay coil 40 are connected in series between the contactor and the second end terminal of potentiometer 35. When relay coil 40 is energized, a switch 41 is opened and a switch 42 is closed. Switch 41 and a relay coil 43 are connected in parallel with relay coil 40. Relay coil 43 closes a switch 44 when energized.

Relay coils 40 and 43 are selected such that relay coil 40 is energized in the absence of light from source 20*a* impinging on cell 20*b*, and relay coil 43 is energized when there is light impingement on photocell 20*b*. One or both of the relays are thus energized each time switch 36 is closed, depending on the position of a mark 21 with respect to photocell 20*b*.

Switch 44 and a relay coil 45 are connected in series between leads 31 and 32. Relay coil 45 closes a switch 46 when energized. Switch 46 and the actuating coil 47 of a stepping switch are connected in series relationship between leads 31 and 32. The stepping switch includes a reset coil 49 and an arm 50, the latter moving progressively across a series of contacts, one of which is designated 51, when coil 47 is energized. Switch 50 is connected to lead 31. A relay coil 53 is connected between terminal 51 and lead 32. When relay coil 53 is energized, switches 54 and 55 are closed. Switch 42 and a relay coil 56 are connected between leads 31 and 32. When relay coil 56 is energized, a switch 57 is closed. Switch 57 and coil 49 are connected in series between leads 31 and 32. Switch 54 is connected in parallel with switch 57.

A timer 58 and switch 55 are connected in series between leads 31 and 32. Timer 58 actuates a switch 59 which is connected between lead 31 and the first end of the first coil 28*a* of reversible motor 28. The second end of coil 28*a* is connected to lead 32. A switch 60 is connected to lead 31 and is adapted to engage terminals 61 and 62 selectively. Terminal 61 is connected to the first end of motor coil 28*a*, and switch 62 is connected to the first end of the second coil 28*b* of motor 28. The second end of coil 28*b* is connected to lead 32. A capacitor 63 and a resistor 64 are connected in series between the first ends of motor coils 28*a* and 28*b*.

A switch 65 and a relay coil 66 are connected in series between leads 31 and 32. Switches 67 and 68 are closed when relay coil 66 is energized. Switch 67 is connected between lead 31 and terminal 62. Switch 68 and limit switch 29 are connected in series between terminal 31 and the terminal of relay coil 66 which is connected to switch 65.

As previously mentioned, blanking press 15 can contain draw rolls which serve to pull web 14 into the press. Normally some slippage occurs if constant tension on the web is not maintained. Brake 13 exerts a retarding force which tends to prevent roll 10 from unwinding. As roll 10 decreases in size, the force required to withdraw the web increases due to the lesser inertia of the roll. Unless corrective action is taken, the printing on the finished blanks may no longer be properly centered. In accordance with this invention, the retarding force exerted by air brake 13 is decreased as the diameter of roll 10 decreases so as to maintain proper alignment of the printing.

Relay coils 40 and 43 are selected so that relay coil 43 operates at a relatively low current and relay coil 40 operates at a relatively high current. When a mark 21 is positioned between light source 20*a* and photocell 20*b*, the photocell has a relatively low resistance and relay coil 40 is energized. In the absence of a mark being positioned between light source 20*a* and photocell 20*b*, cell 20*b* has a relatively high resistance so that only relay coil 43 is energized. Cam 38 is connected to the actuating mechanism of press 15 and is rotated at a speed such that switch 36 is closed at a frequency corresponding to the frequency at which the press is actuated. In normal operation, switch 36 is closed each time the press is actuated. When switch 36 is closed, a circuit is completed through one of the relay coils 40 or 43.

It will first be assumed that the apparatus is operating in such a manner that no mark 21 is positioned between light source 20*a* and photocell 20*b* at the time switch 36 is closed. The resulting current through cell 20*b* is not sufficient to actuate relay coil 40, but is sufficient to actuate relay coil 43. This serves to close switch 44, which in turn energizes relay 45 to close switch 46 and energize actuating coil 47 of the stepping switch. Switch arm 50 is moved to the next contact by coil 47 being energized. If the same mark alignment prevails, switch arm 50 is moved in sequence from contact to contact each time switch 36 is closed by cam 38. When switch arm 50 reaches contact 51, relay coil 56 is energized to close switch 54. This energizes timer 58 which immediately closes switch 59. Closure of switch 59 energizes coil 28*a* of motor 28 to cause the motor to rotate until switch 59 is opened. Timer 38 can advantageously be a time delay relay which closes immediately and then opens after a predetermined time interval. At the end of this interval, rotation of motor 28 is terminated.

When coil 28*a* of motor 28 is energized, the motor is rotated in a first direction which adjusts setpoint shaft 22 of pressure regulator 17 to decrease the pressure in outlet conduit 18. This serves to decrease the retarding force exerted by brake 13. As illustrated schematically in FIG. 2, rotation of motor 28 in this first direction rotates shaft 22 and wheel 23 in a direction such that wheel 23 moves away from limit switch 29.

If a mark 21 is positioned between light source 20*a* and photocell 20*b* at the time switch 36 is closed, relay coil 40 is energized. This serves to open switch 41 which prevents relay coil 43 from being energized. At the same time, switch 42 is closed to energize relay coil 56 and thereby close switch 57. Closure of switch 57 serves to energize reset coil 49 of the rotary switch to move switch arm 50 back to the initial terminal. Switch 54, which is actuated by relay coil 53, is connected in parallel with switch 57 so that relay coil 49 is also energized each time relay coil 53 is energized.

The apparatus can be reset manually by closing switch 65 momentarily. This serves to energize relay coil 66 to close switches 67 and 68. Closure of switch 68 retains the relay coil in an energized position after switch 67 is opened, assuming limit switch 29 is closed. Closure of switch 67 serves to energize coil 28*b* of motor 28 to rotate the motor in a second directon. This rotation continues until wheel 23 moves into engagement with limit switch 29 to open the limit switch, thereby deenergizing relay coil 66 to terminate motor rotation. The position of the limit switch thus establishes the desired initial pressure.

If desired, motor 28 can be rotated in either direction independently of the control circuit by selectively moving switch 60 into contact with either terminal 61 or terminal 62.

While this invention has been described in conjunction with a presently preferred embodiment, it should be evident that it is not limited thereto.

What is claimed is:

1. In a system in which a web of printed material is withdrawn from a roll which is mounted on a shaft and is passed to a means to cut blanks from the web, apparatus to maintain proper alignment of printing on the resulting blanks comprising:

a pneumatically operated brake secured to the shaft to adjust the retarding force tending to prevent the roll from being unwound;

a sensing means positioned to detect register marks on the web;

a source of pneumatic pressure;

an adjustable pressure regulator connected between the source of pneumatic pressure and the brake; and control means responsive to said sensing means to adjust said pressure regulator and thereby the retarding force exerted on said shaft so as to control the rate at which the web is fed to said means to cut.

2. The apparatus of claim 1 wherein said pressure regulator is provided with an adjustable setpoint, and said control means includes a motor connected to said setpoint to adjust same, and means responsive to said sensing means to actuate said motor to adjust said setpoint.

3. The apparatus of claim 2 wherein said control means includes means to actuate said motor for rotation in a first direction when the rate at which the web is fed to said means to cut tends to increase, said motor thereby moving the setpoint of said pressure regulator to vary the pressure applied to the brake to decrease the retarding force applied to the shaft.

4. The apparatus of claim 3 including means responsive to said means to cut blanks to energize said sensing means at a rate proportional to the speed of operation of said means to cut blanks, and means responsive to said sensing means being energized sequentially a predetermined number of times to energize said motor for a predetermined time.

5. The apparatus of claim 4 wherein said means responsive to said sensing means being energized includes a stepping switch which provides an output signal after having been actuated a predetermined number of times in sequence.

6. The apparatus of claim 3 wherein said motor is reversible, whereby rotation of said motor in said first direction tends to increase the retarding force exerted by the air brake and rotation of the motor in a second direction decreases the retarding force exerted by the air brake, and further comprising means to actuate said motor for rotation in the second direction to reset the pressure regulator.

7. The apparatus of claim 6, further comprising a limit switch positioned to be actuated by rotation of said motor a predetermined amount in said second direction, said limit switch being included in said means to actuate said motor for rotation in the second direction to terminate such rotation when the limit switch is actuated.

* * * * *